US005820706A

United States Patent [19]

Bellus et al.

[11] Patent Number: 5,820,706

[45] Date of Patent: Oct. 13, 1998

[54] PROCESS FOR MANUFACTURING A FORGING

[75] Inventors: Jacques Bellus, Scy Chazelles; Pierre Jolly, Saint Etienne; Claude Pichard, Malancourt-la-Montagne; Vincent Jacot, Amanvillers; Christian Tomme, Saint Etienne; Daniel Robat, Saint Julien les Metz, all of France

[73] Assignee: Ascometal, Puteaux, France

[21] Appl. No.: 797,135

[22] Filed: Feb. 10, 1997

[30] Foreign Application Priority Data

Feb. 8, 1996 [FR] France ..... 96 01525

[51] Int. Cl.[6] ..... C21D 8/00

[52] U.S. Cl. ..... 148/649; 148/654

[58] Field of Search ..... 148/649, 653, 148/654, 333–336; 420/109, 105

[56] References Cited

U.S. PATENT DOCUMENTS 5,660,648 8/1997 Takada et al. ..... 148/649

FOREIGN PATENT DOCUMENTS

A-126 995 1/1967 Czechoslovakia .
0072355 2/1983 European Pat. Off. ..... 148/649
A-0 717 116 6/1996 France .
C-673 465 3/1939 Germany .
A-68 973 9/1969 Germany .
A-21 44 325 3/1973 Germany .
A-36 38 712 2/1988 Germany .
4-141549 5/1992 Japan .
6-248386 9/1994 Japan .
A-441 335 8/1975 U.S.S.R. .
A-602 596 4/1978 U.S.S.R. .
800 286 8/1958 United Kingdom .
A-800 286 8/1958 United Kingdom .
1 116 160 6/1968 United Kingdom .

*Primary Examiner*—Deborah Yee
*Attorney, Agent, or Firm*—Oblon, Spivak, McClelland, Maier & Neustadt, P.C.

[57] ABSTRACT

Steel chemical composition of which contains, by weight: $0.1\% \leqq C \leqq 0.4\%$; $1\% \leqq Mn \leqq 1.8\%$; $0.15\% \leqq Si \leqq 1.7\%$; $0\% \leqq Ni \leqq 1\%$; $0\% \leqq Cr \leqq 1.2\%$; $0\% \leqq Mo \leqq 0.3\%$; $0\% \leqq V \leqq 0.3\%$; $Cu \leqq 0.35\%$; optionally from 0.005% to 0.06% of aluminum, optionally boron in contents of between 0.0005% and 0.01%, optionally between 0.005% and 0.03% of titanium, optionally between 0.005% and 0.06% of niobium, optionally from 0.005% to 0.1% of sulfur, optionally up to 0.007% of calcium, optionally up to 0.03% of tellurium, optionally up to 0.05% of selenium, optionally up to 0.05% of bismuth, optionally up to 0.1% of lead, the balance being iron and impurities resulting from smelting. Process for the manufacture of a forging.

14 Claims, No Drawings

PROCESS FOR MANUFACTURING A FORGING

BACKGROUND OF THE INVENTION

1. Field of the invention

The present invention relates to the manufacture of steel forgings having high properties.

2. Discussion of the Prior Art

Steel forgings having high properties, especially forgings having high properties for automobiles, are manufactured according to various techniques which each have drawbacks.

According to a first technique, the forgings are made of a steel of the chromium-molybdenum type, the chemical composition of which comprises, by weight, from 0.25% to 0.45% of carbon, approximately 1% of chromium and approximately 0.25% of molybdenum. Workpieces are forged and then subjected to a quench-and-anneal heat treatment intended to confer on them an annealed martensitic structure in order to obtain especially a tensile strength $R_m$ of about 1000 MPa. This technique has the drawback of being costly and of sometimes generating distortions in the geometry of the forgings.

According to another technique, the forgings are made of a steel containing from 0.3% to 0.4% of carbon, from 1% to 1.7% of manganese, from 0.25% to 1% of silicon and up to 0.1% of vanadium. After the forging operation, the forgings are cooled slowly in order to confer on them a ferrito-pearlitic structure. However, this technique, although less costly than the previous one, has several drawbacks:

- it is not possible to obtain a tensile strength $R_m$ greater than 1000 MPa,
- the ratio of the yield stress to the tensile strength $R_{p0.2}/R_m$ is less than 0.75, which limits the possibilities of lightening the forgings when these are dimensioned in particular with reference to the yield stress,
- the fracture-toughness transition temperature is greater than 50° C., which leads to a low impact strength,
- it is sometimes necessary to adapt the manufacturing plants by adding cooling tunnels in order to obtain suitable cooling after the forging operation.

The forgings may also be made of a steel containing less carbon than in the previous case and be water-quenched when still hot from the forging operation in order to confer on them a bainitic or bainito-martensitic structure. This technique makes it possible to obtain a tensile strength $R_m$ greater than 1000 MPa and a yield stress $R_{p0,2}$ greater than 800 MPa, but it has the drawback of requiring a water-quench which sometimes generates geometrical distortions which require a trueing-up operation or which may even be redhibitory.

Finally, some forgings are made of a steel containing between 0.3% and 0.4% of carbon and between 1.9% and 2.5% of manganese. These are air-cooled after the forging operation so as to give a bainitic structure having high mechanical properties. However, these forgings often include segregated streaks having a martensitic structure making machining difficult.

SUMMARY OF THE INVENTION

The object of the present invention is to provide a steel and a process for the manufacture of forgings having high properties which remedy these drawbacks.

For this purpose, the subject of the invention is a steel for the manufacture of forgings, the chemical composition of which comprises, by weight:

$0.1\% \leqq C \leqq 0.4\%$ $1\% \leqq Mn \leqq 1.8\%$ $0.15\% \leqq Si \leqq 1.7\%$ $0\% \leqq Ni \leqq 1\%$ $0\% \leqq Cr \leqq 1.2\%$ $0\% \leqq Mo \leqq 0.3\%$ $0\% \leqq V \leqq 0.3\%$ $Cu \leqq 0.35\%$ optionally from 0.005% to 0.06% of aluminum, optionally boron in contents of between 0.0005% and 0.01%, optionally between 0.005% and 0.03% of titanium, optionally between 0.005% and 0.06% of niobium, optionally from 0.005% to 0.1% of sulfur, optionally up to 0.006% of calcium, optionally up to 0.03% of tellurium, optionally up to 0.05% of selenium, optionally up to 0.05% of bismuth, optionally up to 0.1% of lead, the balance being iron and impurities resulting from smelting.

Preferably, the carbon content is less than or equal to 0.3%, preferably also the manganese content is less than 1.6%. Depending on the nature of the applications envisaged, the silicon content may be preferably either greater than 1.2% or less than 0.8%. Preferred steel silicon amounts include 1.25, 1.3, 1.4, 1.5, 1.55, 1.6 and 1.65% as well as all ranges and subranges between all values given above and elsewhere for silicon, as well as all values between all these given values.

The invention also relates to a process for the manufacture of a forging, in which:

- a billet made of a steel according to the invention is taken and hot forged in order to obtain a forging,
- the forging is subjected to a heat treatment which includes cooling from a temperature at which the steel is entirely austenitic down to a temperature $T_m$ lying between $M_s$+100° C. and $M_s$−20° C. at a cooling rate Vr greater than 0.5° C./s followed by holding the forging at a temperature between $T_m$ and $T_f$, where $T_f \geqq T_m - 100°$ C., and preferably $T_f \geqq T_m - 60°$ C., for at least 2 minutes so as to obtain a structure containing at least 15%, and preferably at least 30%, of bainite formed between $T_m$ and $T_f$.

Preferably, the cooling rate Vr is greater than 2° C./s.

After the temperature hold between $T_m$ and $T_f$, the forging may be cooled down to room temperature and, optionally, annealed between 150° C. and 650° C.

After the temperature hold between $T_m$ and $T_f$, the forging may also be reheated to a temperature of less than 650° C. and then cooled down to room temperature.

The heat treatment may be carried out either after heating the forging to a temperature greater than $AC_3$ or directly after the forging operation.

DESCRIPTION OF THE PREFERRED EMBODIMENTS

The invention will now be described in a more detailed but non-limiting manner and illustrated by the examples which follow.

The chemical composition of the steel according to the invention comprises, by weight:

- more than 0.1%, and preferably more than 0.15%, of carbon in order to obtain a sufficient hardness, but less than 0.4%, and preferably less than 0.3%, so as to limit the tensile strength $R_m$ to 1200 MPa;
- more than 1% of manganese in order to obtain sufficient hardenability, but less than 1.8%, and preferably less than 1.6%, in order to avoid the formation of segregated bands;
- more than 0.15% of silicon in order to harden the ferrite and, optionally, to promote formation of residual austenite, which improves the fatigue endurance limit, but less than 1.7% since, above this, silicon embrittles the steel; between 0.15% and 0.8%, silicon hardens the ferrite without promoting formation of residual austenite; between 1.2% and 1.7%, silicon promotes formation of residual austenite sufficiently to improve the fatigue endurance limit; depending on the applications, the silicon content may be chosen within one or other of these ranges;
- from 0% to 1% of nickel, from 0% to 1.2% of chromium and from 0% to 0.3% of molybdenum in order to adjust the hardenability;
- optionally, titanium in contents lying between 0.005% and 0.03%;
- optionally, niobium in contents lying between 0.005% and 0.06%;
- optionally, boron in contents lying between 0.0005% and 0.01% in order to supplement the effect of the previous elements with regard to hardenability; in this case, it is preferable that the steel contain titanium in order to reinforce the effect of the boron;
- from 0% to 0.3% of vanadium in order to obtain complementary hardening and to improve the hardenability;
- less than 0.35% of copper, a residual element frequently present in steel smelted from scrap iron, but which, in too great a quantity, has the drawback of impairing forgeability;
- optionally, from 0.005% to 0.06% of aluminum in order to deoxidize the steel and to control austenitic grain coarsening, especially when the silicon content is less than 0.5%;
- optionally, from 0.005% to 0.1% of sulfur, optionally up to 0.006% of calcium, optionally up to 0.03% of tellurium, optionally up to 0.05% of selenium, optionally up to 0.05% of bismuth and optionally up to 0.1% of lead in order to improve machinability;

the balance being iron and impurities resulting from smelting.

In order to manufacture a forging, a billet made of steel according to the invention is taken and hot forged after having heated it to a temperature greater than $AC_3$, preferably greater than 1150° C., and even better between 1200° C. and 1280° C., so as to have conferred on it an entirely austenitic structure and a sufficiently low flow stress. After the forging operation, the forging is subjected to a heat treatment which may be carried out either directly while still hot from the forging operation or after cooling the forging and reheating it above the $AC_3$ temperature of the steel.

The heat treatment includes cooling at a cooling rate Vr, measured on passing through 700° C., greater than 0.5° C./s and preferably greater than 2° C./s down to a temperature $T_m$ lying between $M_s$+100° C. and $M_s$−20° C., $M_s$ being the martensite transformation start temperature of the steel. This cooling is followed by a temperature hold for a time greater than 2 min between the temperature $T_m$ and a temperature $T_f \geqq T_m - 100°$ C. and preferably $T_f \geqq T_m - 60°$ C. The temperature hold is followed either by cooling down to room temperature, optionally supplemented by an anneal between 150° C. and 650° C., or by reheating up to a temperature of less than or equal to 650° C. before cooling down to room temperature.

The object of this heat treatment is to confer on the forging an essentially bainitic structure containing less than 20% of ferrite and at least 15%, preferably at least 30%, of lower bainite formed between $T_m$ and $T_f$. It may be carried out on the entire forging or simply on a part having a particular functionality.

The temperature-hold conditions ($T_m$, $T_f$, duration), as well as the proportions of each of the structures, and in particular the proportion of lower bainite, may be determined, in a manner known by the person skilled in the art, using dilatometry measurements on test bars.

The forgings thus obtained have the advantage of having a tensile strength $R_m$ of between 950 MPa and 1150 MPa, a yield stress $R_{p0.2}$ greater than 750 MPa, a Mesnager fracture toughness K greater than 25 joules/cm$^2$ at 20° C., a machinability at least equal to that of the forgings having a ferrito-pearlitic structure and good fatigue behavior: $\sigma_D/R_m > 0.5$ in rotatory bending at $2\times10^6$ cycles.

EXAMPLES

By way of first example, an axle was manufactured from a steel whose chemical composition contained, in % by weight:

| C | Si | Mn | Ni | Cr | Mo | Cu | V | Al | B | Ti | Nb |
|---|---|---|---|---|---|---|---|---|---|---|---|
| 0.25 | 0.5 | 1.67 | 0.09 | 0.52 | — | 0.199 | 0.2 | 0.03 | — | 0.02 | — |

This steel furthermore contained 0.065% of S in order to improve the machinability. Its $M_s$ temperature was 380° C.

The workpiece was hot forged between 1280° C. and 1050° C. Directly after the forging operation, the forging was cooled in blown air at a rate of 2.6° C./s down to a temperature of 425° C. and then held between 425° C. and 400° C. for 10 min; finally, the forging was cooled down to room temperature by natural air cooling.

The forging thus obtained had a structure containing at least 80% of bainite. Its properties were:

$R_m$=1100 MPa $R_{p0.2}$=870 MPa

A %=10%

Z=60%

By way of a second example, a stub axle was manufactured from a steel whose chemical composition contained, in % by weight:

| C | Si | Mn | Ni | Cr | Mo | Cu | V | Al | B | Ti | Nb |
|---|---|---|---|---|---|---|---|---|---|---|---|
| 0.25 | 0.5 | 1.63 | 0.006 | 0.51 | 0.09 | 0.196 | 0.107 | 0.038 | 0.003 | 0.023 | — |

This steel furthermore contained 0.05% of S in order to improve the machinability. Its $M_s$ temperature was 385° C.

The workpiece was hot forged between 1270° C. and 1040° C. Directly after the forging operation, the forging was cooled in blown air at a rate of 2.6° C./s down to a temperature of 400° C. and then held between 400° C. and 380° C. for 10 min; the forging was then heated to a temperature of 550° C. for 1 hour and then cooled down to room temperature by natural air cooling.

The forging thus obtained had a structure containing at least 80% of bainite. Its properties were:

$R_m$=967 MPa $R_{p0.2}$=822 MPa

A %=12%

Z=60%

By way of a third example, a ball joint was manufactured from a steel whose chemical composition contained, in % by weight:

| C | Si | Mn | Ni | Cr | Mo | Cu | V | Al | B | Ti | Nb |
|---|---|---|---|---|---|---|---|---|---|---|---|
| 0.28 | 0.79 | 1.63 | 0.05 | 0.5 | 0.09 | 0.19 | — | 0.04 | 0.0033 | 0.023 | — |

This steel furthermore contained 0.06% of S in order to improve the machinability. Its $M_s$ temperature was 350° C.

The workpiece was hot forged between 1270° C. and 1060° C. Directly after the forging operation, the forging was cooled in still air at a rate of 1.19° C./s down to a temperature of 380° C. and then held between 380° C. and 360° C. for 10 mins; finally, the forging was cooled down to room temperature by natural air cooling.

The forging thus obtained had a structure containing at least 80% of bainite. Its characteristics were:

$R_m$=1170 MPa $R_{P0.2}$=947 MPa

A %=8%

Z=50%

The forgings thus obtained may especially be forgings for an automobile, such as wishbones, drive shafts and connecting rods, but they may also be shafts, cams or any other forging for various machines.

Obviously, numerous modifications and variations of the present invention are possible in light of the above teachings. It is therefore to be understood that within the scope of the appended claims, the invention may be practiced otherwise than as specifically described herein.

French patent application 96 01525 filed Feb. 8, 1996 is incorporated herein by reference.

What is claimed as new and desired to be secured by Letters Patent of the United States is:

1. A process for the manufacture of a forging, comprising the steps of:

providing a billet of steel whose chemical composition comprises, by weight:

$0.1\% \leqq C \leqq 0.4\%$ $1\% \leqq Mn \leqq 1.8\%$ $0.15\% \leqq Si \leqq 1.7\%$ $0 \leqq Ni \leqq 1\%$ $0\% \leqq Cr \leqq 1.2\%$ $0\% \leqq Mo \leqq 0.3\%$ $0\% \leqq V \leqq 0.3\%$ $Cu \leqq 0.35\%$ optionally from 0.005% to 0.06% of aluminum, optionally boron in contents of between 0.0005% and 0.01%, optionally between 0.005% and 0.03% of titanium, optionally between 0.005% and 0.06% of niobium, optionally from 0.005% to 0.1% of sulfur, optionally up to 0.006% of calcium, optionally up to 0.03% of tellurium, optionally up to 0.05% of selenium, optionally up to 0.05% of bismuth, optionally up to 0.1% of lead, the balance being iron and impurities resulting from smelting;

hot forging said billet in order to obtain a forging, subjecting said foregoing to a heat treatment which consists essentially of cooling from a temperature at which the steel is entirely austenitic down to a temperature $T_m$ lying between $M_s$+100° C. and $M_s$ at a cooling rate Vr greater than 0.5° C./s and without holding the temperature during heat treatment, followed by holding the forging between the temperature $T_m$ and a temperature $T_f$ greater than or equal to $M_s$ for at least 2 minutes so as to obtain a structure containing at least 15% of lower bainite formed between $T_m$ and $T_f$ and less than 20% of pearlite ferrite, $M_s$ being the martensite transformation start temperature of the steel.

2. A process as claimed in claim 1, wherein the steel contains less than 0.3% of carbon.

3. The process as claimed in claim 1, wherein the steel contains less than 1.6% of manganese.

4. The process as claimed in claim 1, wherein the steel contains less than 0.8% of silicon.

5. The process as claimed in claim 1, wherein the steel contains more than 1.2% of silicon.

6. The process as claimed in claim 1, wherein the temperature hold is chosen so that the structure contains at least 30% of lower bainite formed between $T_m$ and $T_f$.

7. The process as claimed in claim 1, wherein the cooling rate Vr is greater than 2° C./s.

8. The process as claimed in claim 1, wherein after the temperature hold at between $T_m$ and $T_f$ the forging is cooled down to room temperature.

9. The process as claimed in claim 8, wherein the cool down to room temperature is supplemented by an anneal between 150° C. and 650° C.

10. The process as claimed in claim 1 wherein after the temperature hold between $T_m$ and $T_f$ the forging is reheated to a temperature of less than 650° C. and then cooled down to room temperature.

11. The process as claimed in claim 1, wherein the heat treatment is carried out after heating the forging to a temperature greater than $AC_3$.

12. The process as claimed in claim 1, wherein the heat treatment is carried out directly after the forging operation.

13. The process as claimed in claim 1, wherein $T_f$ is greater than $M_s$.

14. The process as claimed in claim 1, consisting of said steps.

* * * * *